United States Patent [19]

Pitts et al.

[11] Patent Number: 5,024,898

[45] Date of Patent: Jun. 18, 1991

[54] ERASABLY MARKABLE ARTICLES AND METHODS OF MAKING SUCH ARTICLES

[75] Inventors: Warren R. Pitts, Needham; Hayden F. Estrada, W. Boylston; Peter West, Wellesley, all of Mass.

[73] Assignee: Dennison Manufacturing Company, Framingham, Mass.

[21] Appl. No.: 474,990

[22] Filed: Feb. 6, 1990

Related U.S. Application Data

[63] Continuation-in-part of Ser. No. 360,962, Jun. 2, 1989.

[51] Int. Cl.[5] ..... B32B 27/10; B05D 3/02; B05D 3/06

[52] U.S. Cl. ..... 428/511; 427/54.1; 427/372.2; 427/391; 428/514; 428/690

[58] Field of Search ..... 428/511, 514, 690; 427/54.1, 372.2, 391

[56] References Cited

U.S. PATENT DOCUMENTS 4,393,103 7/1983 Louden ..... 428/514

*Primary Examiner*—William J. Van Balen

*Attorney, Agent, or Firm*—Arthur B. Moore

[57] ABSTRACT

An erasably markable luminescent article formed of a coated substrate that is markable with dry wipe inks without causing permanent discernible distortion of the substrate. The surface after marking is substantially fully erasable. The surface is provided by a smooth coating of cured lacquer perferably a radiation cured lacquer, for example, electron beam radiation cured urethane acrylate. The luminescent appearance results from a phosphorescent layer between the substrate and an unpigmented cured lacquer coating.

18 Claims, No Drawings

ERASABLY MARKABLE ARTICLES AND METHODS OF MAKING SUCH ARTICLES

BACKGROUND OF THE INVENTION

The present application is a continuation-in-part of U.S. Patent Application Ser. No. 360,962 filed June 2, 1989.

The present invention relates to articles of manufacture having one or more erasably markable surfaces. In one preferred embodiment, such articles are flexible and removably adhered to a surface via applied removable pressure sensitive adhesive, many forms of which are well known in the art of pressure sensitive adhesive technology. In another preferred embodiment, such flexible articles are statically chargeable and capable of clinging to a relatively smooth, flat or curved surface such as a wall.

Dry erasable marking systems are known in the art, one of the earliest of which consists of a blackboard, chalk and a dry eraser. Other dry erasable marking systems include felt tip marking instruments which contain specially produced inks which will satisfactorily mark smooth, hard, rigid, plastic surfaced boards and which can be erased from the plastic surface after the ink has dried using a dry eraser, such as a cloth or paper tissue. In addition, erasably markable flexible articles are known in the art, some of which are capable of clinging to a surface such as a wall. However, these flexible articles suffer from one or more of the following disadvantages: Deformation by the chemical materials used to mark the surface; surface deterioration after repeated marking and erasing, accompanied by either loss of dry erase ink ability to wet out the surface or development of ghost images; and inability to be repositioned at will over extensive time periods. For instance, Static Images TM dry erasable electrostatic cling polypropylene film is uncoated. This material is deformed by inks used in commercially available dry erase markers, and repeated image/erase cycles mechanically abrade the surface making the erase step progressively more difficult.

Other polypropylene film surfaced erasably markable articles that are commercially available include Sanford Expo® Dry Erase Surface and Rubbermaid Con-Tact® White Board Erasable Marking Surface. These are both backed by permanent bonding pressure sensitive adhesive. Another polypropylene surfaced erasably markalle article is available as Re-Mark-A-Chart® erasable flip-charts manufactured by Ghent, Inc. The erasably markable character of these surfaces deteriorates gradually with repeated application and erasure of dry wipe inks.

SUMMARY OF THE INVENTION

The articles of the present invention consist of substrates wherein at least one surface of the substrate is markable without permanent discernible distortion of the substrate, said surface after marking being substantially fully erasable, wherein such substrates have a luminescent appearance. Surprisingly, said surface after marking is substantially fully erasable with only one stroke using a conventional dry wipe felt or foam eraser and normal manual effort. The erasable markable surface is provided by a smooth coating of a cured lacquer that is abrasion resistant and essentially impervious to chemical ingredients in commonly available dry erase markers. The luminescent appearance of the substrate results from coating the substrate with a phosphorescent material.

In one embodiment, the phosphorescent material comprises a phosphorescent pigment within a resin binder which is coated on the flexible substrate, which is then overcoated with a smooth coating of the lacquer. The lacquer is then cured to create the erasably markable surface. In a second embodiment, the phosphorescent pigment is mixed with the lacquer, coated on the flexible substrate, and cured. A second layer of the lacquer is then applied and cured in order to create a smooth surface.

DETAILED DESCRIPTION

A variety of erasably markable luminescent articles are provided by following the teachings of the present invention. Preferred substrates for use in the practice of the present invention include flexible substrates such as paper and plastic film and relatively inflexible substrates such as cardboard and laminated pressboard.

A wide variety of paper substrates may be used to produce erasably markable articles in accordance with the teachings set forth herein. In one embodiment, a #60 clay coated pressure sensitive paper label facestock is provided with a coating of radiation cured urethane acrylate lacquer to produce an erasably markable article. In another embodiment of the present invention, an erasably markable article is produced by providing a cured lacquer coating on the front surface of Dennison STICK ON NOTES that utilize a removable adhesive on the back surface. Wire bound, cardboard notebook covers may also be surfaced with cured lacquer to provide erasably markable articles in accordance with the present invention. Other suitable paper substrates will be readily apparent to those skilled in the art.

In all cases, prior to laying down and curing the lacquer coating, the base sheet is first coated or printed with a formulation containing a phosphorescent pigment. The formulation and deposition of such phosphorescent layer is discussed below.

Suitable film substrates for use in the practice of the present invention include polyester and polypropylene films. One preferred film substrate is a statically chargable, strong, biaxially oriented polypropylene multilayer film with a proprietary core that resembles a closed cell foam structure. When electrostatically charged, this preferred film clings to surfaces. This preferred film is available commercially from Mobil Chemical Company under the tradename OPPalyte® TW. Such film itself is erasably markable to a limited degree. However, when the surface of the OPPalyte® TW film, which has not been coated in accordance with the present invention, is marked with commercially available dry erase inks and the inks are left resident on the film for varying periods of time before erasing the markings, component(s) of the inks distort the film within a few hours and eventually stain the surface of the film. The distortion can take the form of an outward dimpling of the surface in the area wherein the dry erase ink was marked. The dimple amplitude is typically about 0.01 inches after 24 hrs. The coating of the present invention eliminates this prior art distortion problem.

The preferred radiation cured lacquer coatings used in the present invention provide a surface which may be marked satisfactorily by commercially available dry wipe erasable marking inks, (e.g., Sandford "Expo", Dixon "White System", Schwan "Stabilo"), and dry erased using a dry wipe eraser, paper tissue, cloth or some other appropriate material. For satisfactory performance, the lacquer coating must be crosslinked to an extent that it avoids significant attack by chemicals in the marking material, thus eliminating or greatly minimizing permanent staining of the erasably markable article and/or distortion of the underlying substrate. Cured lacquers for use in the present invention must also be highly resistant to abrasive wear in order to withstand repetitive marking and erasing. The coating should be smooth to minimize friction forces during marking and erasing.

In addition, provided the substrate to be coated possesses heat resistance, the lacquer coatings employed in this invention may be heat curable chemical systems. For instance, alkyd, urea formaldehyde, melamine and similar high crosslink density resins could be employed on paper substrate. Greater versatility is, however, achieved using radiation curable lacquers. Thermal sensitive stocks can be coated and cured by electron beam (EB) and/or ultraviolet (UV) radiation. The EB radiation procedure causes the least elevation in substrate temperature and is definitely preferred when coating OPPalyte® TM.

In order to have dry erasable ink markers dispense smoothly on the erasably markable articles without any tendency to bead, it is preferable that the surface tension of the lacquer coated surface being marked should be higher than that of the material used to mark the surface. It is recognized in the art that the greater the difference in surface tension, the better the ink will wet out the erasably markable surface. Experience gained with commercially available dry erase markers indicates that the minimum required surface tension of the cured coating depends mainly on the solvent(s) and/or surface active agents used in the dry erase marker. If the bulk solvent employed is denatured alcohol then the surface tension at 22° C. of the cured coating must be about 22 dyne/cm or greater. On the other hand, if methyl isobutyl ketone or ethyl acetate is the dominant solvent, the cured coating must exhibit a minimum surface tension of about 25 dyne/cm at 22° C., otherwise the dry erasable ink will bead up on the surface giving a severely deformed image. All commercially available dry erase markers tested in this invention satisfactorily imaged the cured coatings described in this invention provided the coatings exhibited a surface tension at 22° C. of about 25 dyne/cm or greater.

Caution is required in the manufacturing of items disclosed in this invention, most particularly in terms of inadvertent presence of silicones that can dramatically lower the surface tension of the cured coated substrate. The handling of pressure sensitive label stock with its associated silicone release sheet is always a potential source of deleterious silicone on the cured coated surface. Silicone contaminant on the surface can in the some instances be removed by wiping off with a solvent bearing cloth.

Innumerable radiation curable formulations could be used as coatings in the invention described herein, including acrylate based monomer/oligomer blends. Examples of suitable acrylate functionalized polymers include epoxy acrylates and, more preferably, urethane acrylate lacquers that provide exceptional flexibility and abrasion resistance. A preferred urethane acrylate lacquer formulation for use in the present invention is available commercially from W.R. Grace & Company, Photopolymer Systems under the name Radiation Curable Lacquer OPL-6E. Commercially available dry erasable ink formulations tested in this invention satisfactorily marked the dry erase surface without disturbing the structure of this cured urethane acrylate lacquer, even on repeated marking/erase use.

Urethane acrylate lacquer coatings for the practice of the present invention may be cured by EB and/or UV irradiation. The UV curing system must employ lamps of appropriate spectral output, suitable reflector shape and web speeds to afford the required cure. Determination of the parameters of curing is within the skill in the art. The lacquer can be EB cured with or without a photoinitiator present. Both EB and UV curing methods utilize solventless chemistries which permit preparation of a wide variety of erasably markable articles. Applicants have observed that the odor which is normally associated with UV coatings is absent in articles having the OPL-6E overcoating.

In addition to dry erasably markable articles, the present invention also provides wet erasably markable articles. For instance, when an erasably markable surface is provided by a radiation cured urethane acrylate lacquer as taught herein, a permanent ink marker, such as Dennison Carter's MARKS-A-LOT®, can be erased from the surface by overwriting the dried "permanent" mark with a dry erase marker containing ethyl alcohol as a solvent or erasing with an eraser, or other suitable material, containing ethyl alcohol.

Permanent inks adhere to a substrate by design and usually contain a film former to promote adhesion and durability. On the other hand, dry erase inks which do not adhere to substrates by design usually contain not just a film former to carry colorant but also additives that are incompatible with the film former thus promoting poor adhesion to substrates.

A dry erasable article in accordance with the present invention was formed by providing at least one surface of an OPPalyte® TW film with a radiation cured coating of W.R. Grace OPL-6E urethane acrylate lacquer. Such articles retained the ability to cling to a surface such as a wall. In fact, if desired, the film may be coated on both surfaces without losing the cling property. Thus, an important aspect of the present invention is that the cured coatings employed herein have the additional property that they do not interfere with the inherent electrostatic property of the OPPalyte® TW film.

The capacitance of the polypropylene sheet is a function of the geometry of the dielectric material used. Large sheets of statically charged OPPalyte® TW film provided with a coating of W.R. Grace OPL-6E lacquer readily adhered to a surface such as a wall. It was found that with progressively smaller sized sheets, the force of attraction of the film to a surface becomes less effective. If the normal attractive force is overcome by frictional force of a dry erase marker on the film surface plus the force exerted by the individual doing the writing, the film may move on the adhering surface, and may or may not fall to the ground. With smaller sheets an adhesive stripe of removable pressure sensitive adhesive, as used on Dennison paper STICK ON NOTES, may be applied to the opposite side of the OPL-6E coated film, allowing the small sized sheet of film to adhere to surfaces and be imaged by dry erase markers without displacing the film. In addition, with large sheets of the coated OPPalyte® TM material an edge of removable pressure sensitive adhesive allows the reinforced stacking of one sheet on top of another as in a pad. The top sheet can subsequently be dry erase imaged, peeled back but not totally removed from underlying sheets and later dropped back in place into the neat, pad format. When suspending the pad from a wall through electrostatic adhesion, such top sheet may be electrostatically adhered to the wall adjacent the pad.

OPPalyte® TW film coated with OPL-6E was cured by both UV and EB curing methods. It was found that the EB curing is preferred because this treatment does not heat the web to the same degree as UV lamps, thus reducing the shrinkage of the polypropylene film.

The OPL-6E coated OPPalyte® TW film resisted over 1000 marks, rubs and re-marks in the same area, i.e., the surface did not degrade and resisted ink stain, even when using a marker containing methyl isobutyl ketone, one of the more aggressive solvents used in dry erase ink technology. The test was terminated at this point.

OPPalyte® TW film was coated on one or both sides to eliminate the surface deformation problem encountered when imaged by dry erase markers, yet in both instances it still retained its electrostatic cling properties. With the applied overcoating, the film will adhere to solid surfaces regardless of whether it is a coated or uncoated side that contacts the solid surface.

Prior to laying down and curing the smooth lacquer coating, the flexible base sheet first receives a phosphorescent layer. This layer may comprise a phosphorescent pigment in a resin binder. The pigment loading should be sufficient to avoid spotting, yet not so high as to cause pigment flaking due to volume concentrations above a critical level. A typical range of pigment concentration is 40–50 percent by volume. The coating thickness and the pigment to binder ratio should be sufficient to provide adequate luminescence. Typical thicknesses are about 20–50 microns, advantageously around 30–35 microns. Because fragmentation of the phosphorescent pigment particles may cause a significant reduction in luminescence, the coating technique should be chosen so as to avoid undue shear forces on the particles.

The pigment particle size should not be so small that only a top layer of particles absorbs incident light, therefore reducing the intensity of re-emitted light in the spectral range of the pigment. If the pigment particles are too large, on the other hand, dark spaces can be observed between pigment particles. Similar observations can be made if the pigment concentration is too low. Typical pigment particle diameters in the applicants' tests were 1.7–3.0 microns, averaging 2.3 microns.

In tests of phosphorescent erasable substrates incorporating yellow, green, or blue phosphorescent materials, such substrates had a pleasing, glossy appearance. At very low intensities of ambient light, the luminiscence provided by such substrates was sufficient to permit the user to effectively inscribe, erase, and reuse the article.

Applicants have successfully used the same OPL-6E formulation as the binder for a phosphorescent pigment, cured this material, then overcoated the substrate with a smooth layer of the OPL-6E lacquer and repeated the curing step. Both UV and electron beam curing may be employed without significantly reducing the employed luminescence of the resulting product.

This invention will be further understood with reference to the following examples which are purely exemplary in nature and are not meant to be utilized to limit the scope of the invention.

EXAMPLE 1

A green phosphorescent pigment was obtained from Shannon Luminous Materials Inc., Santa Ana, California, their catalog no. B-330. The pigment was mixed with OPL-6E urethane lacquer and coated onto clay coated 60# James River matte paper facestock using a no. 9 Meyer rod. The coated substrate was passed under a Fusion System "D" and/or "H" UV lamp at 50 feet/minute to cure. The average thickness of the pigmented coating was 33 microns, average particle size 2.3 microns. The cured, coated stock was then overcoated with unpigmented OPL-6E lacquer using a #9 Meyer Rod, then UV cured as above.

The resulting substrate evidenced a luminescent, glossy appearance with smooth surface texture. When inscribed with a dry erase marker, the coated substrate could be fully erased with only one stroke using a conventional felt dry wipe eraser and only normal manual effort.

EXAMPLE 2

The materials and process sequence of Example 1 were repeated, with the exception that both curing steps were effected by exposing the lacquer coatings to a machine setting of 3 megarad dose of EB radiation. No perceptable reduction of luminescense of the fluxed phosphorescent pigment was observed. This visual observation was confirmed using a UV/VIS Spectrometer Lambda 3B Integrating Sphere of Perkin Elmer over the visible spectrum, which indicated only a 1–2% loss of light reflectance.

EXAMPLE 3

The materials and process sequence of Example 1 were repeated except that the pigmented layer consisted of polyurethane resin with "invisible green" phosphorescent pigment, from Shannon Luminous Materials, Inc., Santa Ana, California, their catalog number S-430-P. This resin was coated over the clay coated 60# James River facestock using a no. 9 Meyer rod, at an average thickness of 37 microns, then cured by heating for five minutes at 300 degrees F. The coated paper was then overcoated with unpigmented OPL-6E lacquer and cured as in Example 1.

We claim:

1. An erasably markable luminescent article comprising a substrate having at least two surfaces, wherein at least one surface of the substrate is markable with dry wipe inks, said surface after marking being substantially fully erasable, and said markable surface being provided by a smooth coating of cured lacquer, and said luminescent appearance resulting from a phosphorescent material which is embedded within the cured lacquer.

2. The article of claim 1, wherein the substrate is paper or cardboard.

3. The article of claim 1, wherein the substrate is plastic film.

4. The article of claim 1, wherein the cured lacquer comprises a radiation cured lacquer.

5. The article of claim 4, wherein the radiation cured lacquer comprises urethane acrylate.

6. The article of claim 1, wherein the phosphorescent material is selected from the group consisting of sulfides of zinc, strontium, cadmium, and calcium.

7. An erasably markable luminescent article comprising a substrate having at least two surfaces, wherein at least one surface of the substrate is markable with dry wipe inks, said surface after marking being substantially fully erasable, and said markable surface being provided by a smooth coating of cured lacquer, and said luminescent appearance resulting from a phosphorescent layer between said substrate and said smooth coating of cured lacquer.

8. The article of claim 7, wherein the substrate is paper or cardboard.

9. The article of claim 7, wherein the substrate is plastic film.

10. The article of claim 7, wherein the cured lacquer comprises a radiation cured lacquer.

11. The article of claim 10 wherein the radiation cured lacquer comprises urethane acrylate.

12. The article of claim 7, wherein the phosphorescent material is selected from the group consisting of sulfides of zinc, strontium, cadmium, and calcium.

13. A method for producing an erasably markable, luminescent article comprising a substrate having at least two surfaces wherein at least one surface of the substrate is markable with dry wipe inks without permanent discernible distortion of the substrate, the method comprising:

a. forming over at least one surface of the substrate a layer of phosphorescent material;

b. forming over said layer of phosphorescent material a continuous layer of curable lacquer; and c. exposing the article to an energy source to cure the lacquer, resulting in a smooth coating of cured lacquer forming said markable surface wherein said markable surface has the property that it prevents permanent discernible distortion of the substrate after marking with dry wipe ink and is substantially fully erasable after said marking.

14. A method in accordance with claim 13, wherein the lacquer is cured by exposing to heat.

15. A method in accordance with claim 13, wherein the lacquer is cured by exposing to electron beam and/or ultraviolet radiation.

16. A method in accordance with claim 13, wherein the layer of phosphorescent material is continuous.

17. A method in accordance with claim 13, wherein prior to step (a), the one surface is corona treated.

18. A method for producing an erasably markable, luminescent article comprising a substrate having at least two surfaces wherein at least one surface of the substrate is markable with dry wipe inks without permanent discernible distortion of the substrate, the method comprising:

a. forming over at least one surface of the substrate a continuous layer of curable lacquer containing a phosphorescent material; and b. exposing the article to an energy source to cure the lacquer, resulting in a smooth coating of cured lacquer forming said markable surface wherein said markable surface has the property that it prevents permanent discernible distortion of the substrate after marking with dry wipe ink and is substantially fully erasable after said marking.

* * * * *